United States Patent [19]

Brace

[11] Patent Number: 4,926,558

[45] Date of Patent: May 22, 1990

[54] AXE MAUL APPARATUS

[76] Inventor: Regie P. Brace, Lot 33, Bert's Trailer Park, 401 S. Rte. 7, Milton, Vt. 05468

[21] Appl. No.: 320,222

[22] Filed: Mar. 7, 1989

[51] Int. Cl.[5] ..... B26B 3/00

[52] U.S. Cl. ..... 30/308.1; 144/193 C

[58] Field of Search ..... 30/308.1, 308.2, 308.3; 144/193 C, 193 D, 193 E, 193 F

[56] References Cited

U.S. PATENT DOCUMENTS 4,044,808 8/1977 Kolonia ..... 144/193 D

*Primary Examiner*—Frederick R. Schmidt

*Assistant Examiner*—M. Rachuba

*Attorney, Agent, or Firm*—Thomas N. Neiman

[57] ABSTRACT

An improved axe maul apparatus that uses minimum resistance penetration points to initiate the primary split of the block of wood which allows for less sticking once the axe maul enters the block of wood. A series of rounded ribs provide an area of less resistance as the axe edge enters the block of wood and then the flaring wedge forces the split edge of the blocked wood to be rapidly exploded apart. The areas between the rounded ribs are carved out to further minimize the resistance encountered by the apparatus.

4 Claims, 3 Drawing Sheets

AXE MAUL APPARATUS

This invention pertains to wood splitting devices, and in particular to such wood splitting apparatus, such as an axe maul, which has means for initiating penetration of the wood block with points comprised of very small diameters to facilitate the splitting of the wood.

Axes and mauls are well known in the wood industry as the prime means of manually splitting wood. Their are many examples of these type tools in use in this area. These tools, along with hydraulic wood splitters and chain saws are the prime pieces of equipment used by individuals in knocking down trees and then cutting the tree into blocks of wood. These blocks of wood are then split into four to six pieces and stacked into position. There have been a number of attempts to improve the efficiency of the standard axe, that is to improve the ease of splitting wood by hand.

The following references provide an example of previous attempts at making improvements to the standard axe. U.S. PAt. No. 4,044,808 issued to Robert A. Kolonia for a Splitting Assembly on Aug. 30, 1977. This patent shows an axe to which moveable levers have been added to assist in the splitting force by spreading the split after impact of the axe blade. The U.S. Pat. No. 4,440,205 issued to George Hillinger for a Wedge and Axe Head on 3 Apr. 1984 shows a pair of levers that are pivotally mounted in spaces found in the head. These levers pivot in opposite directions about a common axis to provide a greater initial splitting force than would be normally available with a standard axe. The difficulties that are inherent in these designs and should be overcome include the following: when a device has moving parts and is placed in a hostile environment that is present in woodlots with mud, moisture and the pounding that is associated with lumbering, there will be a good chance that the moving parts will incur difficulties and break down: and none of these devices show a blade that has a single or multiple small contact points to ease entry into the wood. their blades have an extended vertical edge. That edge provides more resistance than a contact point or points.

Clearly, it is desirable for a axe maul apparatus that does not have the difficulties described with moving parts and, also shows at least one small diameter contact point. It is the object of this invention, then to set forth an improved axe maul apparatus which avoids the disadvantages limitations, above-recited, which obtain in prior wood splitting systems.

It is also the object of this invention to teach a axe maul apparatus which is simple to use and that will enable the operator to more easily split wood than he or she currently is able to with standard axes. It is another object of this invention to teach an apparatus that provides carved out ribs rather than attaching ribs to the maul head which would result in an increase in resistance as the axe maul apparatus enters the wood. The carved out areas combined with the penetration points reduce the resistance present and minimize the head of the axe maul apparatus sticking in the wood. Particularly, it is the object of this invention to set forth an axe maul apparatus, for splitting blocks of wood or the like, comprising a head; said head having first means for initiating the splitting of a block of wood located at one end of said head; said first means comprises at least one material penetration means; said head further having second means for flaring apart the sections of said block of wood; said second means comprises a plurality of flaring wedges; a plurality of spaced apart ribs; and maul means located on said head at the opposite said first means.

Further objects and features of this invention will become more apparent by reference to the following description taken in conjunction with the accompanying figures, in which.

Figure 1:
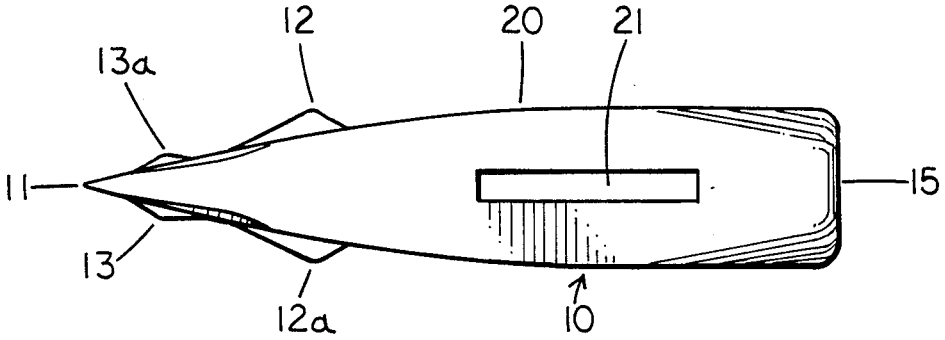
FIG. 1 is an top view of the a novel axe maul apparatus.
Figure 2:
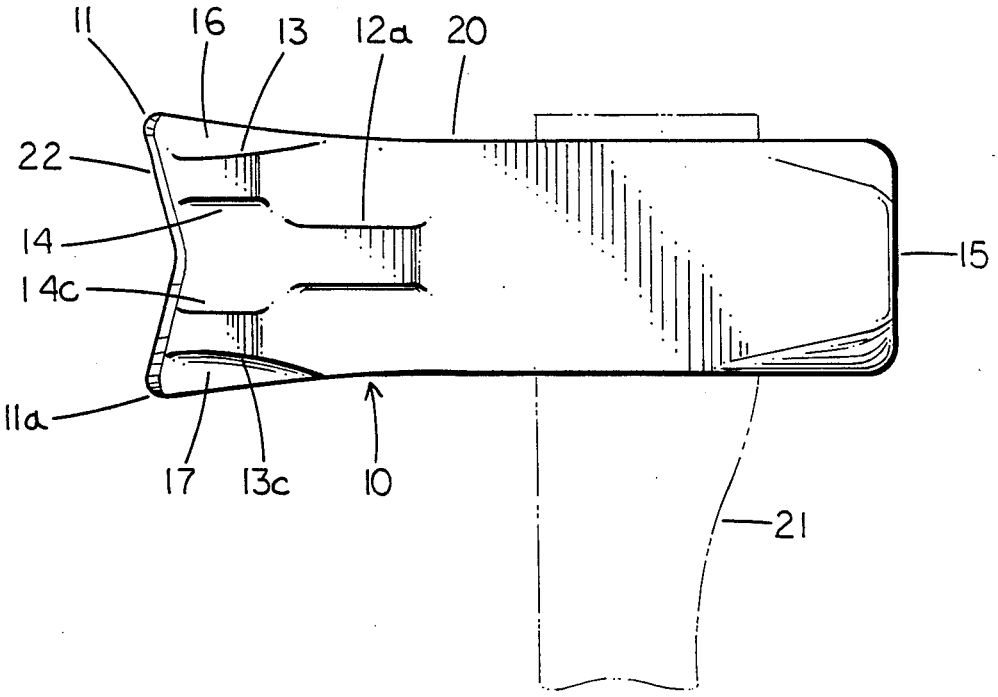
FIG. 2 is a side view thereof.

As shown in the figures, the axe maul apparatus 10 is comprised of a head 20 which is attached to a handle 21. The head 20 has axe blade 22 that has a v - shaped design. The blade 22 has a plurality of penetration points 11 and **11*a*. These penetration points 11 and 11*a* enter the wood as the axe is being swung with far less resistance than is experienced with a standard axe blade that has a long vertical dimension. The axe head 20 has rounded flaring wedges 12 and 12*a* located approximately at the horizontal centerline on each side of the head. These flaring wedges impart a rapid splitting apart of the wood as it rides over the wedges, in other words it explodes the piece of wood. Between the blade 22 and the flaring wedges 12 and 12*a* are a series of rounded ribs 13, and 13*c* located above and below the wedges 12 and 12*a*. These ribs 13 and 13*c* are designed to provide a smooth, rippled surface to enable the wood to slide over the ribs easily. The areas 14 and 14*c* between the ribs and in front of the wedges are carved out areas that provide zero resistance to the path of the wood. The areas 16 above the upper ribs 13 and the areas 17 below the bottom ribs 13*c* are also curved out to minimize resistance. The maul end 15 is at the opposite end of the head 20**.

Figure 3:
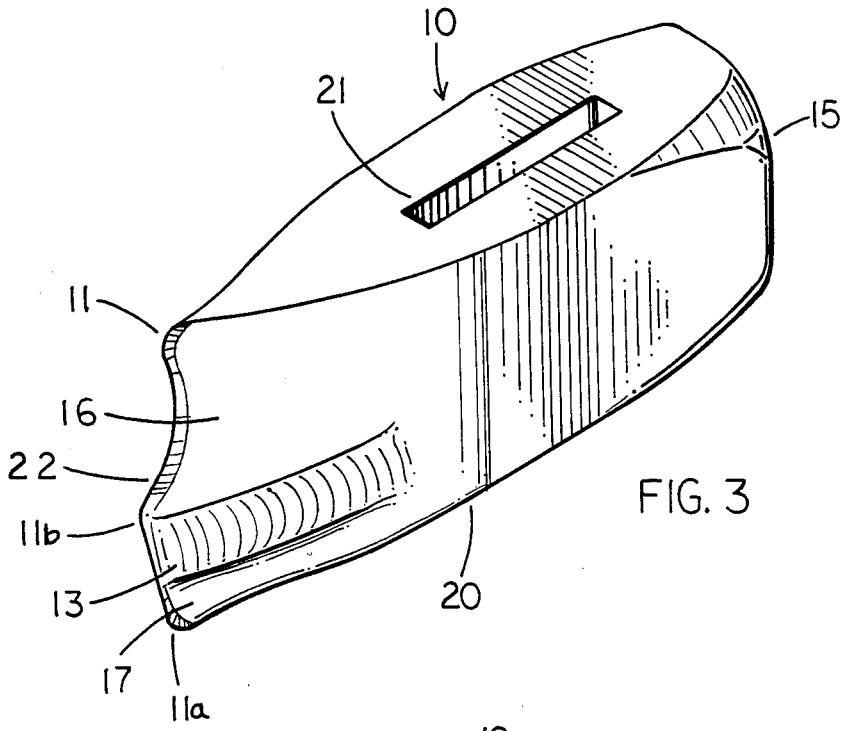
FIG. 3 is a perspective view of an alternate embodiment of the axe maul apparatus.
Figure 4:
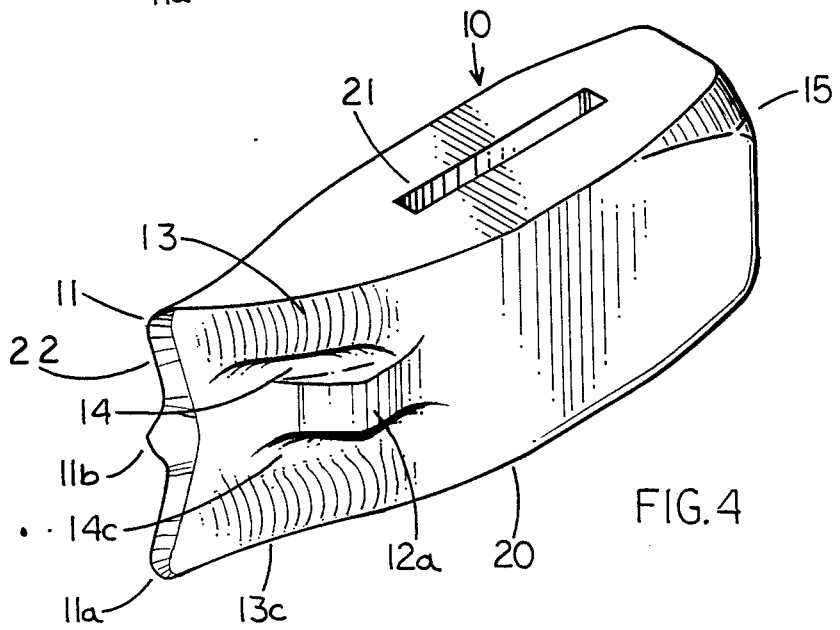
FIG. 4 is a perspective view of an additional embodiment of the axe maul apparatus.
Figure 5:
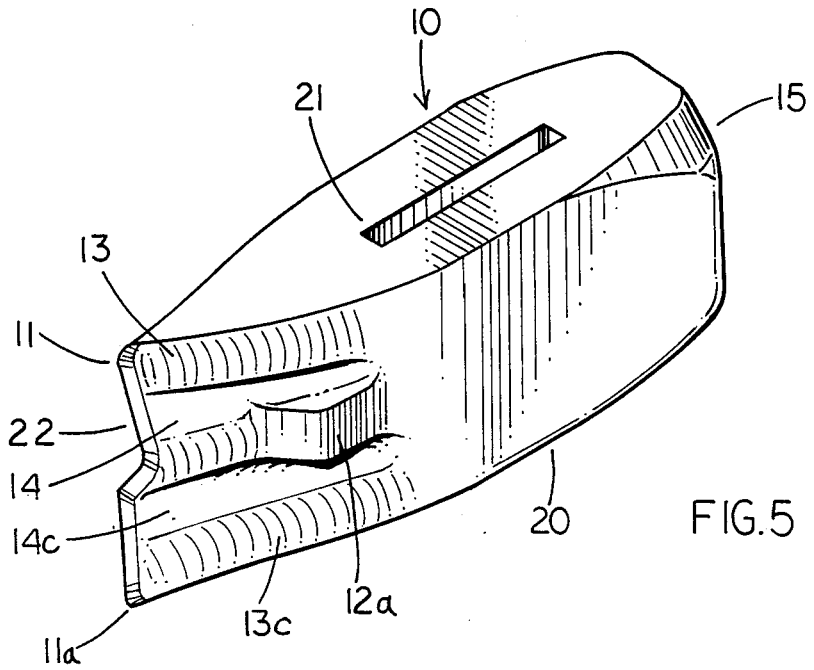
FIG. 5 is a perspective view of another embodiment of the axe maul apparatus.
Figure 6:
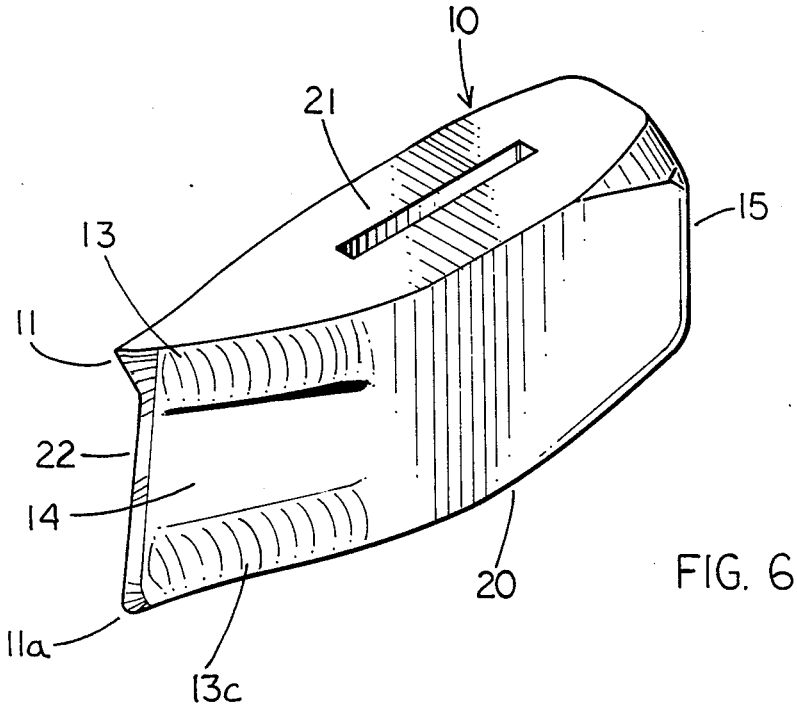
FIG. 6 is a perspective view of a further embodiment of the novel axe maul apparatus.

FIG. 3 shows an alternative embodiment of the novel axe maul means. This embodiment shows an offset inverted v - shaped blade 22 that has three penetration points 11, **11*a* and 11*b*. This embodiment does not shown the wedges found in the the other versions, but does have the series of rounded ribs 13 located below the horizontal centerline of the side of the head 20. Another version is shown in FIG. 4. This embodiment shows a w - shaped blade 22 that has three penetration points 11, 11*a* and 11*b*. The rounded ribs 13, and 13*c* are located on the upper and lower edges of the head. FIGS. 5 and 6** show alternative embodiments of the novel axe maul. A multi-stage leading edge and an offset v-shaped blade are shown.

The user of this are maul swings the axe and the penetration points contact the wood. Because the wood is initially penetrated by the individual points, resistance is minimized and the initial splitting takes place. Sticking of the axe maul in the mood is minimized because of the lack of cutting edge of the leading edge of the blade and the wedge being carved out further back on the head, instead of at the initial penetration points. The axe head penetrates that wood which rides over the rounded ribs and the carved out areas until it comes in contact with the wedges which forcibly explode the sections of wood outward. This action measurably improves the efficiency of splitting ability of the axe maul. The head also allows for ease of prying as necessary due to the design of the penetration contact points when retrieving the axe maul head from the wood being split.

While I have described my invention in connection with specific embodiments thereof, it is clearly to be understood that this is done only by way of example and not as a limitation to the scope of my invention as set forth in the objects thereof and in the appended claims.

I claim:

1. An axe maul apparatus, for splitting blocks of wood or the like, comprising:

a head comprising a one piece block with no moveable parts;

said head having first means for initiating the splitting of a block of wood located at the leading edge of said head;

said first means comprises at least one material penetration means;

said material penetration means comprising means defining tapered leading edge contact points;

said contact points having a cutting edge located behind said contact points;

said head further having second means for flaring apart the sections of said block of wood;

said second means comprises a plurality of flaring wedges;

a plurality of spaced apart ribs; and maul means located on said head at the end opposite said first means.

2. An axe maul apparatus, according to claim 1, wherein:

said flaring wedges comprising a protruding portion location on each side of said head approximately along the centerline behind said first means.

3. An axe maul apparatus, according to claim 1, wherein:

said ribs comprising rolled extensions located above and below said flaring wedges that extend to the upper and lower edges of said head.

4. An axe maul apparatus, according to claim 3, wherein:

said ribs having valley portions located between said ribs and said flaring wedges; and said valley portions comprise carved cut out areas.

* * * * *